US009840913B1

(12) United States Patent
Levine et al.

(10) Patent No.: US 9,840,913 B1
(45) Date of Patent: Dec. 12, 2017

(54) DEVICE, SYSTEM AND METHOD FOR REINFORCING A TUNNEL

(71) Applicant: X Development LLC, Mountain View, CA (US)

(72) Inventors: Gabriella Levine, New York, NY (US); Richard W. DeVaul, Menlo Park, CA (US); Eric H. C. Liu, Redwood City, CA (US)

(73) Assignee: X Development LLC, Mountain View, CA (US)

( * ) Notice: Subject to any disclaimer, the term of this patent is extended or adjusted under 35 U.S.C. 154(b) by 24 days.

(21) Appl. No.: 14/920,793

(22) Filed: Oct. 22, 2015

(51) Int. Cl.

| | |
|---|---|
| ***E21D 9/13*** | (2006.01) |
| ***E21D 11/40*** | (2006.01) |
| ***E21D 9/11*** | (2006.01) |
| *E21D 11/00* | (2006.01) |
| *E21C 41/24* | (2006.01) |

(52) U.S. Cl.
CPC ..... *E21D 11/403* (2013.01); *E21D 9/111* (2013.01); *E21D 9/13* (2013.01)

(58) Field of Classification Search
None
See application file for complete search history.

(56) References Cited

U.S. PATENT DOCUMENTS 3,447,571 A * 6/1969 Lejeune ..... F16L 11/082 138/138
3,986,536 A * 10/1976 Janson ..... E21B 25/08 141/311 R
4,106,296 A * 8/1978 Leonard, Jr. ..... C09K 17/18 404/75
4,784,223 A 11/1988 Worrell et al.
5,141,363 A * 8/1992 Stephens ..... B28C 5/386 366/10
5,330,292 A * 7/1994 Sakanishi ..... G08C 23/00 299/1.05
5,813,482 A * 9/1998 Barbera ..... E21B 7/046 175/171
6,554,368 B2 * 4/2003 Drake ..... E21B 7/002 299/1.3

(Continued)

FOREIGN PATENT DOCUMENTS

| | | |
|---|---|---|
| EP | 1223306 | 7/2002 |
| GB | 2518442 | 3/2015 |
| WO | WO 2015041613 | 3/2015 |

*Primary Examiner* — Benjamin Fiorello
*Assistant Examiner* — Douglas S Wood
(74) *Attorney, Agent, or Firm* — Christensen O'Connor Johnson Kindness PLLC

(57) ABSTRACT

Techniques and mechanisms to form a reinforcement structure including dirt processed during drilling of a tunnel. In an embodiment, a device includes a drill head to drill an underground tunnel, where a housing of the device takes in dirt produced by such drilling. A mixer and other components of the device variously condition the dirt to produce a casing material that is subsequently provided to a compactor of the device. The compactor extrudes the casing material through a die. The extruded casing material is eliminated from the device to form a reinforcement structure at one or more sides of the tunnel. In another embodiment, a fiber optic cable is paid out from the device into the tunnel during the drilling, or is pulled into the tunnel by the device during the drilling.

22 Claims, 5 Drawing Sheets

(56) References Cited

U.S. PATENT DOCUMENTS

| | | | | |
|---|---|---|---|---|
| 7,334,637 | B2 | 2/2008 | Smith, Jr. | |
| 7,448,692 | B2 * | 11/2008 | Drake | E21C 41/24 299/55 |
| 9,004,163 | B2 | 4/2015 | Tverlid | |
| 2015/0083422 | A1 | 3/2015 | Pritchard | |

* cited by examiner

DEVICE, SYSTEM AND METHOD FOR REINFORCING A TUNNEL

BACKGROUND

1. Technical Field

This disclosure relates generally to tunnel drilling and more particularly, but not exclusively, to reinforcing a tunnel during drilling thereof.

2. Background Art

Computing and communication networks have been expanding worldwide into an increasing number and variety of environments. One factor driving the proliferation of network infrastructure is the increase in speed and capacity that is provided by new generations of fiber optic network hardware. Another factor is the increasing number and variety of devices that can avail of a given access point coupled at an end of a network link. Still another factor is the lower cost, in terms of both materials and labor, which comes with more affordable technology and economies of scale.

Although networks are increasingly available in a wider range of environments, it is still typically preferable or even necessary to route at least some network cabling underground. As successive generations of technologies continue to trend toward fast, high capacity and affordable network solutions adaptable to a wider range of environments, there is expected to be increasing demand for incremental improvements in techniques to perform tunneling that facilitate the construction of underground network infrastructure.

BRIEF DESCRIPTION OF THE DRAWINGS

The various embodiments of the present invention are illustrated by way of example, and not by way of limitation, in the figures of the accompanying drawings and in which.

DETAILED DESCRIPTION

Figure 1:
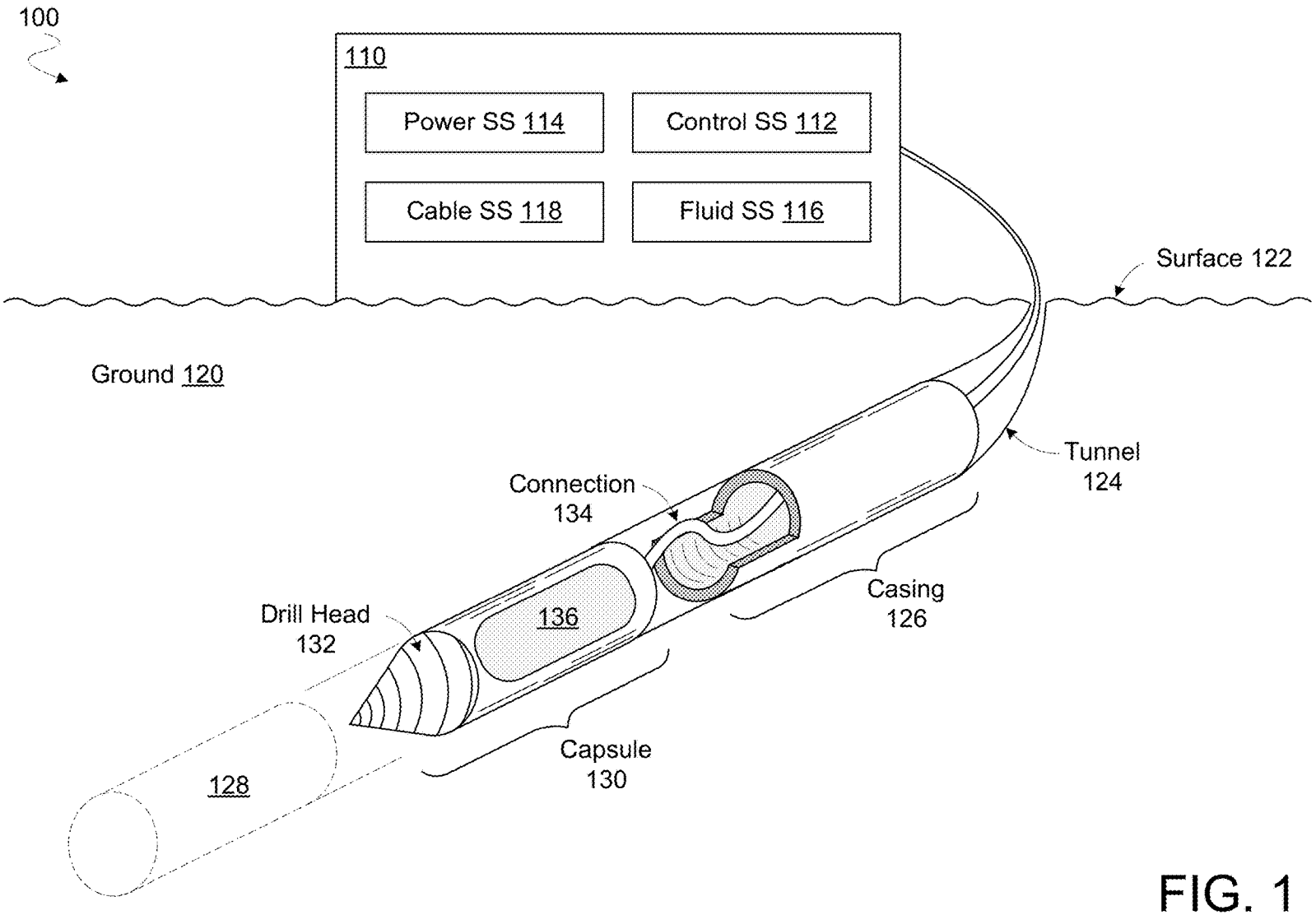
FIG. 1 is a hybrid perspective view and functional block diagram illustrating elements of a system to reinforce a tunnel according to an embodiment.

Embodiments of a device, system and method for reinforcing a tunnel are described herein. In the following description, numerous specific details are set forth to provide a thorough understanding of the embodiments. One skilled in the relevant art will recognize, however, that the techniques described herein may be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In an embodiment, a device that is configured to drill a tunnel includes mechanisms operable to form a structure (referred to herein as a reinforcement structure) comprising material through which the device has previously drilled. The reinforcement structure—e.g., a casing—may be formed by conditioning and compacting the drill material, which is subsequently extruded or otherwise ejected from a back end of the device. The drill device may thus deposit any of a variety of structures to reinforce a tunnel that is formed in its wake. For brevity, the term "capsule" is used herein to refer to such a device.

A capsule according to one embodiment may include a drill head to drill through soil, sand and/or other aggregate material and utilize at least a portion of the drilled material as a feedstock for processing to form a casing or other reinforcement structure that is built in a wake of the capsule's path. Unless otherwise indicated, "dirt" is used herein to refer to such drilled material, where other terms ("earth," "soil," "ground" etc.) variously refer to undrilled material from which dirt is obtained. Feedstock dirt may be compacted in the capsule and subsequently eliminated from the capsule under pressure to form a reinforcement structure that is to function as a supporting floor, ceiling and/or sidewall structure within the tunnel. Material eliminated to form a reinforcement structure is referred to herein as casing material.

In some embodiments, a compound may be mixed with at least some dirt to aid in formation of the casing material. The compound may include an epoxy or other material that is suitable to function as a binder for chemically and/or mechanically improving structural integrity that is to be provided with the compacted dirt. In some applications, a capsule functions to further lay conductive, fiberoptic and/or other cable in the tunnel. For example, the capsule may contain a spool to pay out cable during tunneling, where the capsule forms a casing material that is to jacket the cable and/or the tunnel as the capsule moves through the ground.

FIG. 1 illustrates elements of a system 100 to form a reinforcement structure in a tunnel according to an embodiment. System 100 may include a capsule 130 to drill a tunnel 124 at least partially through ground 120, where other resources 110 of system 100 (or alternatively, coupled to system 100) are variously disposed, for example, on or above a surface 122 of ground 120. During drilling in ground 120, capsule 130 may form a reinforcement structure to reinforce tunnel 124. One example of such reinforcement structure according to an embodiment is represented by the illustrative casing 126, which is shown partially in cross-section. Casing 126 may be comprised at least in part of dirt that is received into capsule 130 as a result of the drilling in ground 120.

For example, a drill head 132 of capsule 130 may encounter a volume 128 of ground 120 including soil or other such material. During drilling, dirt may be received into capsule 130 from volume 128. In one embodiment, capsule 130 includes one or more intakes (not shown) disposed in or around drill head 132—e.g., where the one or more intakes are selectively controllable or otherwise configured to receive from outside of capsule 130 dirt that is loosened by the drilling with dill head 132.

At least a portion of such dirt may be conditioned and/or otherwise processed by structures in capsule 130 (such as the illustrative reinforcement unit 136) to form a casing material that is subsequently eliminated from capsule 130 to form a portion of casing 126 or another reinforcement structure distinct from casing 126. Processing by reinforcement unit 136 may include, for example, shaking or otherwise breaking up dirt, sifting or otherwise separating dirt by size and/or mixing dirt with one or both of water and a binder. Alternatively or in addition, reinforcement unit 136 may compress casing material and extrude or otherwise eliminate such casing material from capsule 130 to provide reinforcement of tunnel 124. In some embodiments, reinforcement unit 136 (or another component of capsule 130) may cure the casing material at least in part. The casing material may be exposed to heat, light (e.g., ultraviolet light), pressure, air and/or other such conditions to promote such curing.

In an illustrative scenario according to one embodiment, other resources 110—variously included in or coupled to system 100—may include a control sub-system (SS) 112 comprising logic (e.g., hardware and/or software) to exchange control communications with capsule 130. Such communications may facilitate control sub-system 112 sensing, controlling or otherwise determining direction, depth, speed or other characteristics of drilling in ground 120 by capsule 130. Control sub-system 112 may be configured to further control, or otherwise operate with, one or more other ones of resources 110. By way of illustration and not limitation, resources 110 may further comprise a power sub-system 114 that is to provide electrical power to capsule 130, a fluid sub-system 116 that is to provide one or more fluids to capsule 130 and/or a cable sub-system 118 to facilitate the laying of one or more cables in tunnel 124. Control sub-system 112 may be coupled to control or otherwise communicate with some or all such power sub-system 114, fluid sub-system 116, cable sub-system 118 and/or any of a variety of other mechanisms that might be additionally or alternatively included in or coupled to resources 110. In other embodiments, some or all of resources 110 are distinct from system 100, and are instead to variously couple to and operate with system 100.

One or more cables, hoses and or other connections—e.g., including the illustrative connection 134—may variously couple capsule 130 to some or all of resources 110. In an illustrative scenario according to one embodiment, one or more connections coupled between capsule 130 and resources 110 include a communication cable to facilitate communication between capsule 130 and control sub-system 112. Alternatively or in addition, such one or more connections may include a power cable to deliver power from power sub-system 114 for operation of reinforcement unit 136, drill head 132 and/or one or more other components of capsule 130. In some embodiments, the one or more connections include a tube or tubes each to exchange a respective one of pneumatics, hydraulics, water and/or any of a variety of other fluids. Pneumatics or hydraulics may be drive operation of one or more pumps, actuators or other mechanisms of capsule 130. Water may be provided via a supply line to capsule 130 for mixing with dirt to aid in formation of a casing material. A return fluid line may send from capsule 130 an effluent, slurry of other waste that comprises, for example, a mixture of water and other dirt that is not to be used to reinforce tunnel 124. A connection may include a fiber optic or other cable that is paid out from capsule 130 or, for example, from cable subsystem 118. In some embodiments, a connection provides capsule 130 with a liquid epoxy or other binder material to be mixed with dirt—e.g., in addition to or instead of water—to aid in formation of a casing material. Although certain embodiments are not limited in this regard, such a binder may instead be a dry material and/or may be stored locally in capsule 130.

Figure 2:
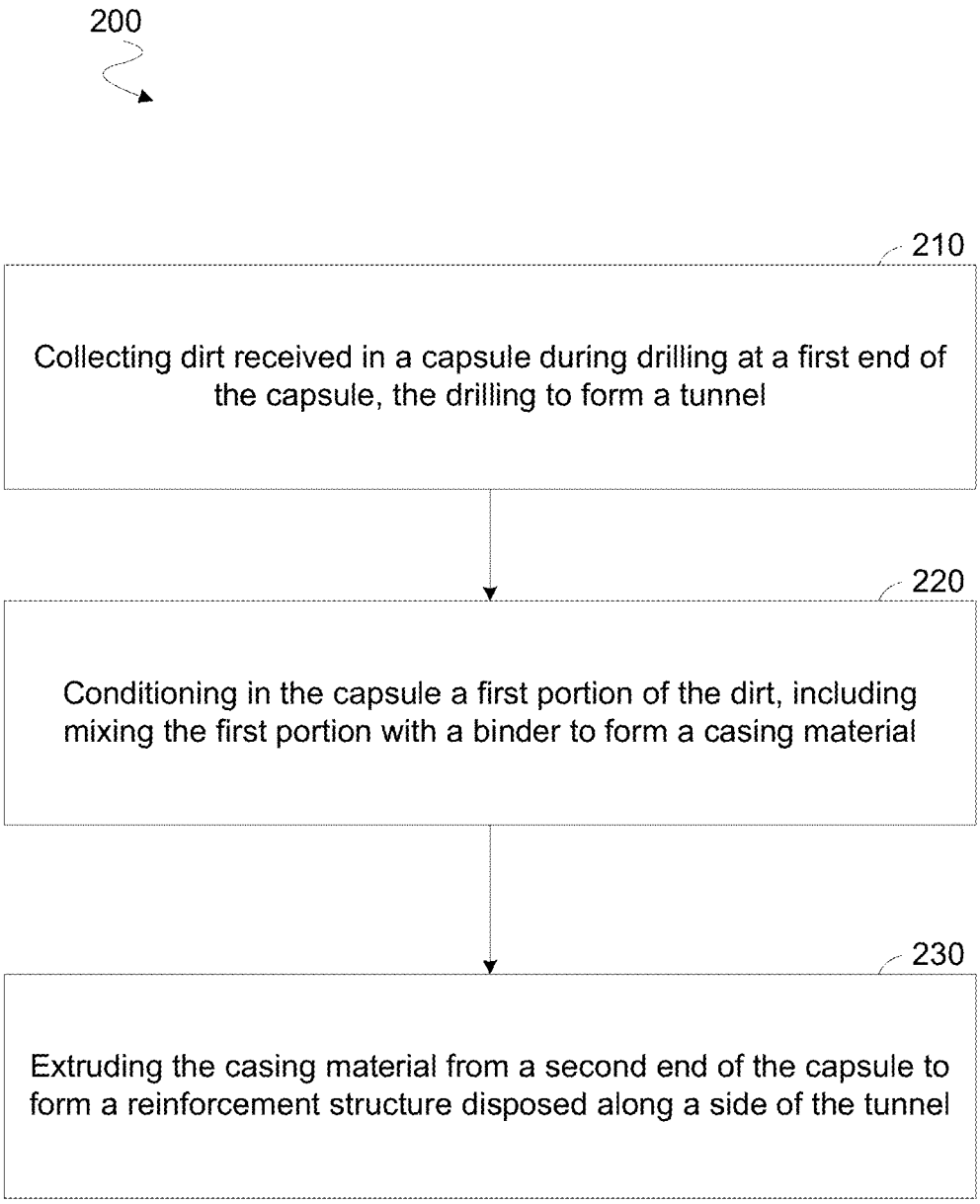
FIG. 2 is a flow diagram illustrating elements of a method for reinforcing a tunnel according to an embodiment.

FIG. 2 illustrates elements of a method 200 to reinforce a tunnel according to an embodiment. Method 200 may be performed with a device or system including some or all of the features of capsule 130, for example. In an embodiment, method 200 includes, at 210, collecting dirt received in a capsule during drilling at a first end of the capsule. The drilling may form a tunnel that, for example, is to accommodate a communication line, power line and/or other connection. Collecting the dirt at 210 may include receiving the dirt through one or more intakes that are formed in or near a drill head of the capsule.

Method 200 may further comprise, at 220, conditioning a first portion of the dirt in the capsule, including mixing the first portion with a binder to form a casing material. As used herein with respect dirt received in a drilling device, "conditioning" refers to processing of such dirt in aid of preparing the dirt for inclusion in a casing material. Such conditioning may include mixing the dirt with other material such as water and/or a binder. Alternatively or in addition, such conditioning may change an integrity (e.g., particle size), temperature, dryness or other characteristic of the dirt, or of a mixture that includes such dirt.

In an embodiment, method 200 further includes, at 230, extruding the casing material from a second end of the capsule (e.g., opposite the first end) to form a reinforcement structure disposed along a side of the tunnel. The reinforcement structure may extend around a periphery of the tunnel. In some embodiments, another portion of the dirt collected at 210 is prevented from being included in any reinforcement structure that is to reinforce the tunnel. For example, the other dirt portion may be deposited directly into the tunnel, where the other dirt portion is outside of, but surrounded by, the reinforcement structure. Alternatively or in addition, another dirt portion may be transported, via a hose extending from the capsule, as part of a slurry, effluent or other waste to be removed from the tunnel.

Figure 3:
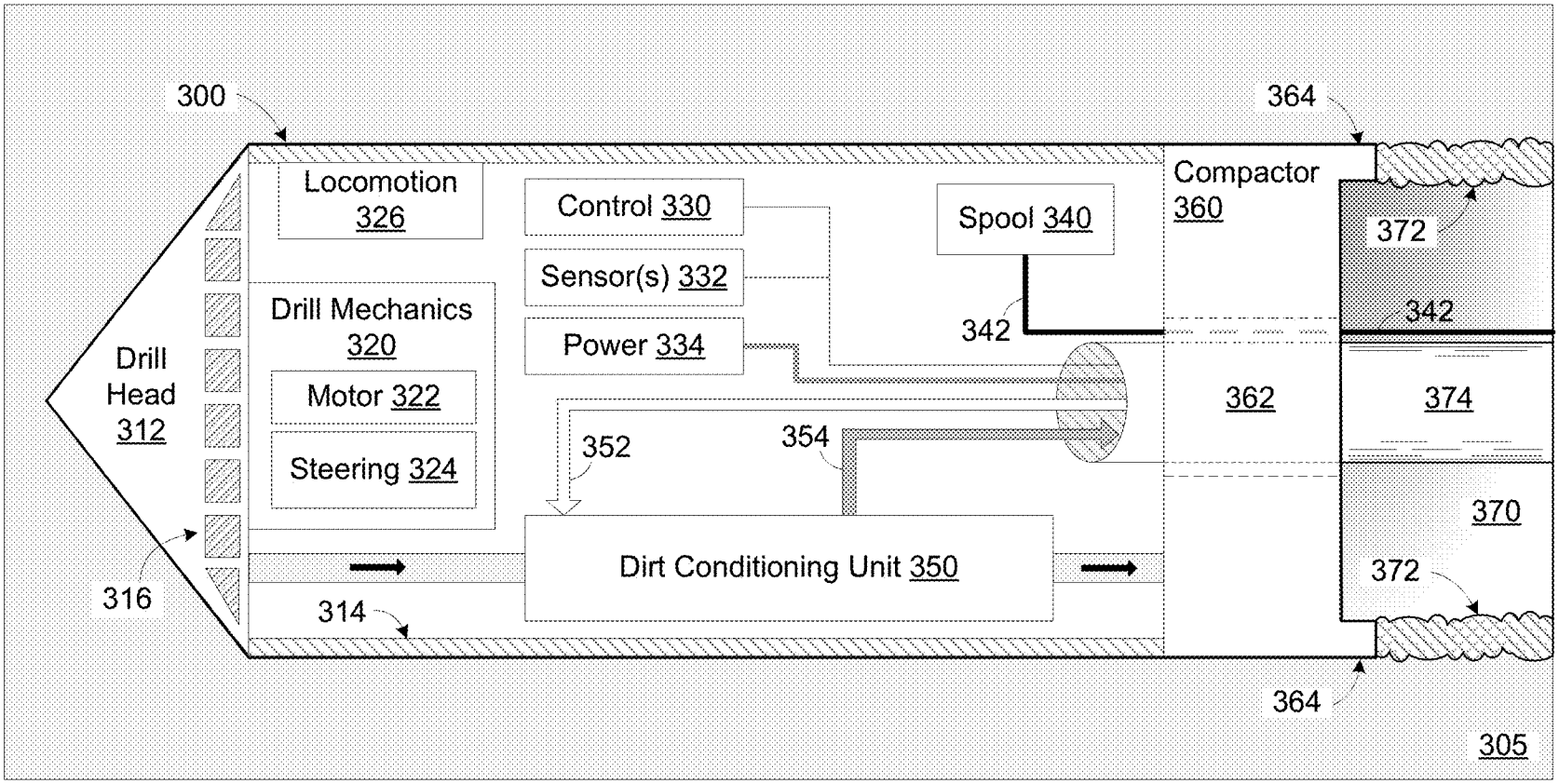
FIG. 3 is a functional block diagram illustrating elements of a device to drill and reinforce a tunnel according to an embodiment.

FIG. 3 shows elements of a capsule 300 to provide a tunnel reinforcement structure according to an embodiment. Capsule 300 may include one or more features of capsule 130—e.g., where mechanisms of capsule 300 provide some or all of the functionality of reinforcement unit 136. In an embodiment, operation of capsule 300 is according to method 200.

Capsule 300 may comprise a drill head 312 and a housing 314 in which is disposed mechanisms to operate drill head 312 for drilling of a tunnel into (e.g., through) soil, sand and/or other such material. In an illustrative scenario according to one embodiment, operation of capsule 300 may drill into ground 305 with drill head 312 and form in a wake of capsule 300 a casing 372 that is to reinforce a tunnel 370 created by such drilling. Drill head 312 may include structures comprising metal, carbon fiber and/or other suitable material—for example, including stainless steel coated with hardened carbon steel—the structures configured to rotate and, in some embodiments, to further oscillate back and forth in a linear motion. Drill mechanics 320 to operate drill head 312 may include, for example, an electric, pneumatic or other motor, such as the illustrative motor 322, to drive rotation or other motion of drill head 312. For example, a pneumatic pump may cause liquefaction as it pushes drill head 312 back and forth, vibrating an adjoining portion of ground 305 to allow drill head 312 to spin through more pliable material. In some embodiments, drill mechanics 320 further comprises a steering unit 324 to selectively change an angle of drill head 312 relative to housing 314, which in turn may facilitate changing a direction of drilling by capsule 300. In one illustrative embodiment, steering unit 324 includes a cable actuator to provide at least 2-axis (up/down and left/right) directional steering of drill head 312. However, drill head 312 and drill mechanics 320 may include any of a variety of additional or alternative components to aid in drilling in ground 305—e.g., where such components include mechanisms adapted from conventional drilling techniques.

Mechanisms for providing locomotion of capsule 300 (represented by the illustrative locomotion 326) may include one or more movable slats, wheels, pistons, treads, paddles or other such mechanisms to provide pushing, rolling and/or other means for moving capsule 300 along tunnel 370 during drilling. Such motion may result from selective application of force at an oblique angle against sidewalls of tunnel 370 that adjoin housing 314. Locomotion 326 may be powered, for example, with pneumatics or hydraulics provided by one or more lines—represented by the illustrative connection 374—coupling capsule 300 to resources (e.g., fluid subsystem 116) above ground 305. Certain embodiments are not limited with respect to a particular mechanism by which capsule 300 provides for locomotion through tunnel 370.

Motion of drill head 312 may break down a portion of ground 305, resulting in dirt being pushed into, or otherwise collected by, one or more intakes 316 that are formed in or proximate to drill head 312. Such dirt may be received by a dirt conditioning unit 350 that is to use at least a portion of the dirt as feedstock for the formation of casing 372. Dirt conditioning unit 350 may perform sifting, separating, hydrating, mixing and/or other operations to create a casing material that includes dirt received via one or more intakes 316. Production of the casing material may include dirt conditioning unit 350 mixing dirt with one or more fluids—e.g., water and/or a binder—that, for example, are provided to capsule 300 via one or more tubes 352 of connection 374 (or other such connections to above-ground resources). In some embodiments, dirt conditioning unit 350 is further coupled to send from capsule 300 waste material that is not to be included in the casing material. For example, one or more return lines 354 may send out through tunnel 370 a slurry, effluent or other mixture of water and waste dirt. The casing material produced with dirt conditioning unit 350 may be provided to a compactor 360 of capsule 360. Compactor 360 may include an annular (or other) die 364—shown in cross-section in FIG. 3—through which the casing material is extruded to form a casing 372 and/or other such reinforcement structure in (e.g., along a side of) tunnel 370. In some embodiments, capsule 300 further comprises a component—e.g., in compactor 360—to provide at least partial curing of the casing material before or during elimination via die 364. Such curing may include exposing the casing material to heat and/or light (e.g., UV light) to activate a binder material. Although certain embodiments are not limited in this regard, capsule 300 may eliminate at least some waste material (for example, stones too large for die 364) through the channel 362 for deposition directly into tunnel 370.

Connection 374 is merely one example of one or more hoses, cables, wires and/or other hardware that links capsule 300 to resources above ground 305. In an embodiment, compactor 360 and/or die 364 extend radially around a channel 362 that is configured to receive such connection hardware for coupling with capsule 300. Channel 362 may accommodate various exchanges between capsule 300 and above ground resources via one or more tubes 352, one or more return lines 354 and/or any of the variety of additional or alternative links. In the example embodiment of capsule 300, control 330 represents mechanisms to direct or otherwise control other components of capsule 300 during drilling with drill head 312. One or more sensors 332 represents mechanisms to sense conditions during such drilling. Power 334 represents mechanisms to store and/or distribute power in capsule 300 during drilling with drill head 312. In such an embodiment, some of all of control 330, one or more sensors 332 and power 334 may variously participate in respective exchanges with above-ground resources—e.g., via channel 362 and connection 374.

For example, power 334 may include one or more batteries to receive power that is delivered to capsule 300 via connection 374 and through channel 362. Such power may may be variously distributed for operation of drill mechanics 320, one or more sensors 332, dirt conditioning unit 350, compactor 360 and/or the like. Alternatively or in addition, circuitry of control 330 may exchange control signals with other components of capsule 300 and/or may exchange signals via channel 362 with above-ground resources (not shown). In some embodiments, one or more sensors 332 comprise, for example, any of the variety of sensors to monitor operation of drill head 312 and/or other machinery within housing 314. Channel 362 may facilitate a communication of sensor information from one or more sensors 332 to above ground resources—e.g., via connection 374. One or more sensors 332 may include any of the variety of one or more heat sensors, pressure sensors or other mechanisms to sense operational characteristics of dirt conditioning unit 350 or other components of capsule 300. Alternatively for in addition, one or more sensors 332 may sense hardness, moisture and/or other characteristics of dirt that is processed by dirt conditioning unit 350. In some embodiments, one or more sensors 332 perform spectroscopic or other analysis of dirt received via one or more inputs 316. Such analysis may be used to facilitate determining a direction of drilling for capsule 300.

One or more sensors 332 may include a receiver and/or a transmitter to participate in signal exchanges (e.g., with control 330 and/or with above-ground resources) that facilitate positioning of capsule 300 in a coordinate system. Such signal exchanges may take place between capsule 300 and one or more beacons located above ground 305. In some embodiments, ultrasonic or other echolocation signals may be variously received from such beacons through ground 305. Alternatively or in addition, one or more sensors 332 may analyze the strength of a radio signal received via tunnel 370. Based on signal exchanges with such beacons and, for example, a predetermined map information, capsule 300 may be steered through ground 305 toward a destination. Certain embodiments are not limited to particular mechanisms by which control signals, sensor signals and/or power is communicated between components of capsule 300.

In some embodiments, drilling by capsule 300 is to aid in laying a cable or other link in tunnel 370. By way of illustration and not limitation, housing 314 may accommodate a spool 340 for a cable 342 including optical fibers, conductive wire or other communication link structures. As tunnel 370 is drilled and capsule 300 moves through tunnel 370, cable 342 may pay out from spool 340, and through channel 362, into tunnel 342. In another embodiment, spool 340 is instead located above ground 305, where an end of cable 342 is tethered or otherwise anchored to capsule 300, and where movement of capsule 300 through tunnel 370 pulls cable 342 into tunnel 370.

Figure 4:
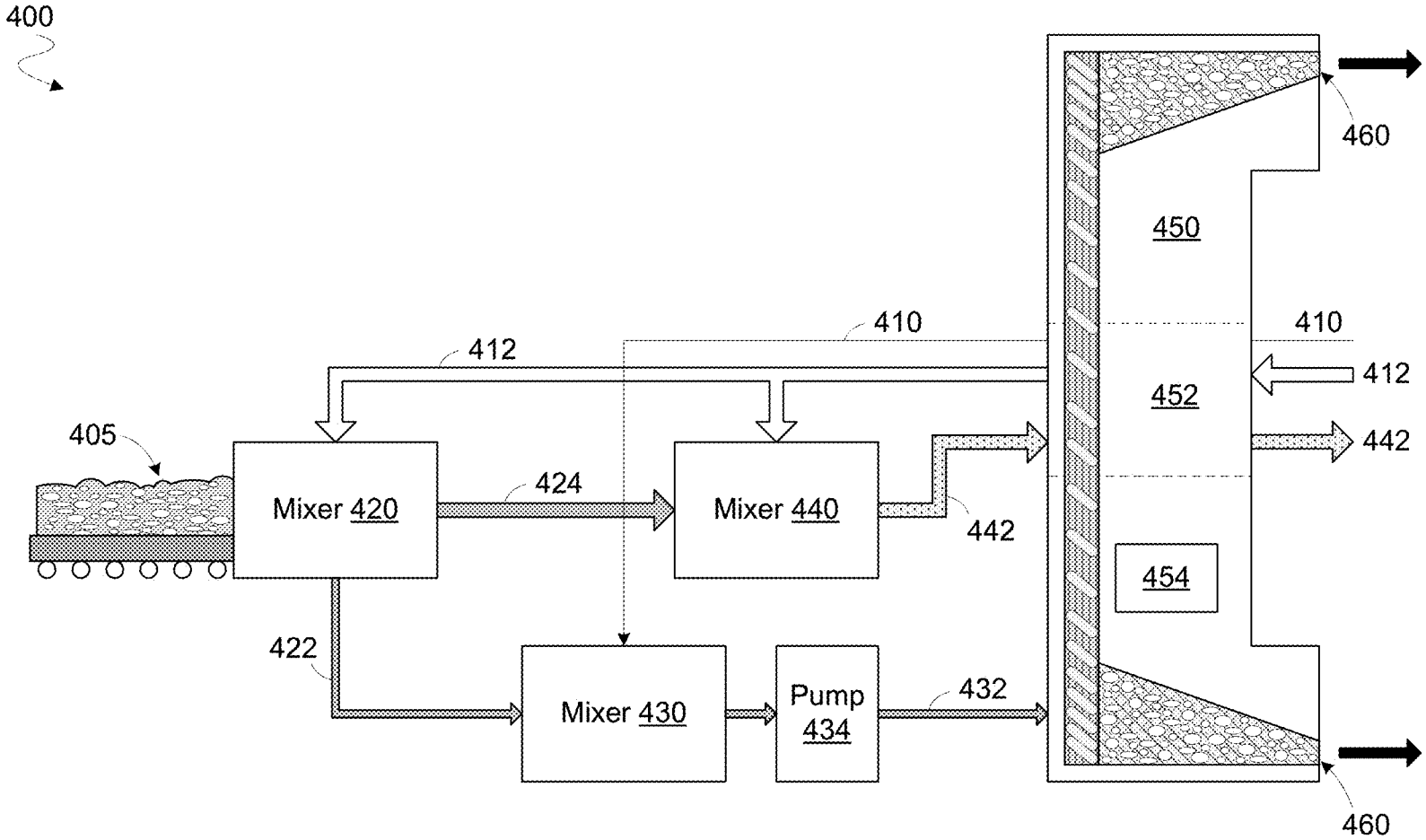
FIG. 4 is a functional block diagram illustrating elements of a device to condition soil for reinforcing a tunnel according to an embodiment.

FIG. 4 illustrates elements of a device 400 to reinforce a tunnel according to an embodiment. Device 400 may include some or all of the features of one of capsules 130, 300, for example. In an embodiment, operation of device 400 is performed according to method 200.

Device 400 is one example of an embodiment that provides functionality such as that of dirt conditioning unit 350 and compactor 360. In an embodiment, one or more mixers of device 400—e.g., including the illustrative mixers, 420, 430, 440—are variously configured to process respective portions of dirt 405 that is received by device 400 during drilling of a tunnel. Although some embodiments are not limited in this regard, dirt 405 may be disintegrated (e.g., crushed), sifted or otherwise conditioned by other mechanisms (not shown) of device 400 prior to, and in preparation for, mixing at mixer 420. In an embodiment, device 400 receives dirt through intakes that are disposed within or near a drill head (not shown) that is included in or coupled to device 400. Such dirt may be drawn into device 400 by a vacuum applied from within device 400 and/or by a positive pressure differential from outside of device 400. Device 400 may include a sieve that rotates in order to pass dirt 405 through pores using centripetal motion. The sieve may pass dirt 405 through one or more screens that, for example, each include pores of respective sizes. Dirt 405 may be broken up into particles of sizes (less than 0.3 mm, for example) that are small enough for extrusion from device 400. In one embodiment, at least a portion of relatively small dirt particles may be directed for inclusion in casing material, where other dirt is directed for removal out of the tunnel or for deposition as waste material within the tunnel.

Device 400 may be coupled to exchange any of one or more materials via respective hoses that extend through the tunnel and couple device 400 to external resources (e.g., including resources 110). Such materials may include one or more of supply water 412, effluent 442 and binder 410. Although certain embodiments are not limited in this regard, some or all such materials may be exchanged via a channel 452 that extends through a compactor 450 of device 400.

In an illustrative scenario according to one embodiment, mixer 420 may receive, and form a mixture of, dirt 405 and a portion of supply water 420. Different portions of the mixture may be variously directed for inclusion in a reinforcement structure or, alternatively, for removal via the tunnel to an above-ground location. For example, a first portion 422 of the mixture may be sent to mixer 430, where another portion 424 of the mixture is provided to mixer 440. Mixer 440 may further dilute the portion 424 with additional supply water 412 to from a slurry of other fluid that, for example, is output from device 400 as an effluent 442.

Mixer 430 may provide for further mixing of portion 422 with binder 410 to form a casing material 432. In an embodiment, binder 410 includes one or both components of a two-part epoxy to act as an adhesive or sealant that, for example, begins to cure when exposed to one or more of water, heat, UV light, pressure and/or other such conditions. Binder 410 may function at least in part as a solvent, for example, that breaks down organic material of soil and/or other material. In one embodiment, binder 410 includes any of a variety of quick-setting cement materials—where at least a portion of dirt 405 is to function as aggregate within the cement to create a concrete tube. Binder 410 may be housed in a chamber (not shown) of device 400, from which binder 410 may be dripped, spayed or otherwise disposed into mixer 430—e.g., by a small direct current pump and solenoid operable to open to allow one or more components of binder 410 into mixer 430 at a specific rate. Deposition of binder 410 into mixer 430 may be at a rate that, for example, is based on a detected hardness (or other condition) of the ground through which device 400 drills.

A pump 434 may convey casing material 432 from mixer 430 to a compactor 450 (e.g., compactor 360) that extrudes or otherwise shapes casing material 432 to form a reinforcement structure. Any of a variety of means may be used for conveying dirt (or a mixture including dirt) into, through or from device 400, according to various embodiments. For example, pump 434 and other such conveyance means or compacting means of device 400—e.g., including compactor 450—may comprise a peristaltic pump, a screw pump or the like. The shaped casing material 432 may be eliminated from an annular output 460 of compactor 460 (shown in cross-section). Extrusion of the casing material from output 460 may push device 400 in an opposite direction to advance drilling of the tunnel. In some embodiments, a cure unit 454 included in or proximate to compactor 450 may provide for at least partial curing of casing material 432 prior to or during shaping thereof by compactor 450. For example, cure unit 454 may expose casing material 432 to heat, light and/or other conditions to promote curing by binder 430.

Figure 5:
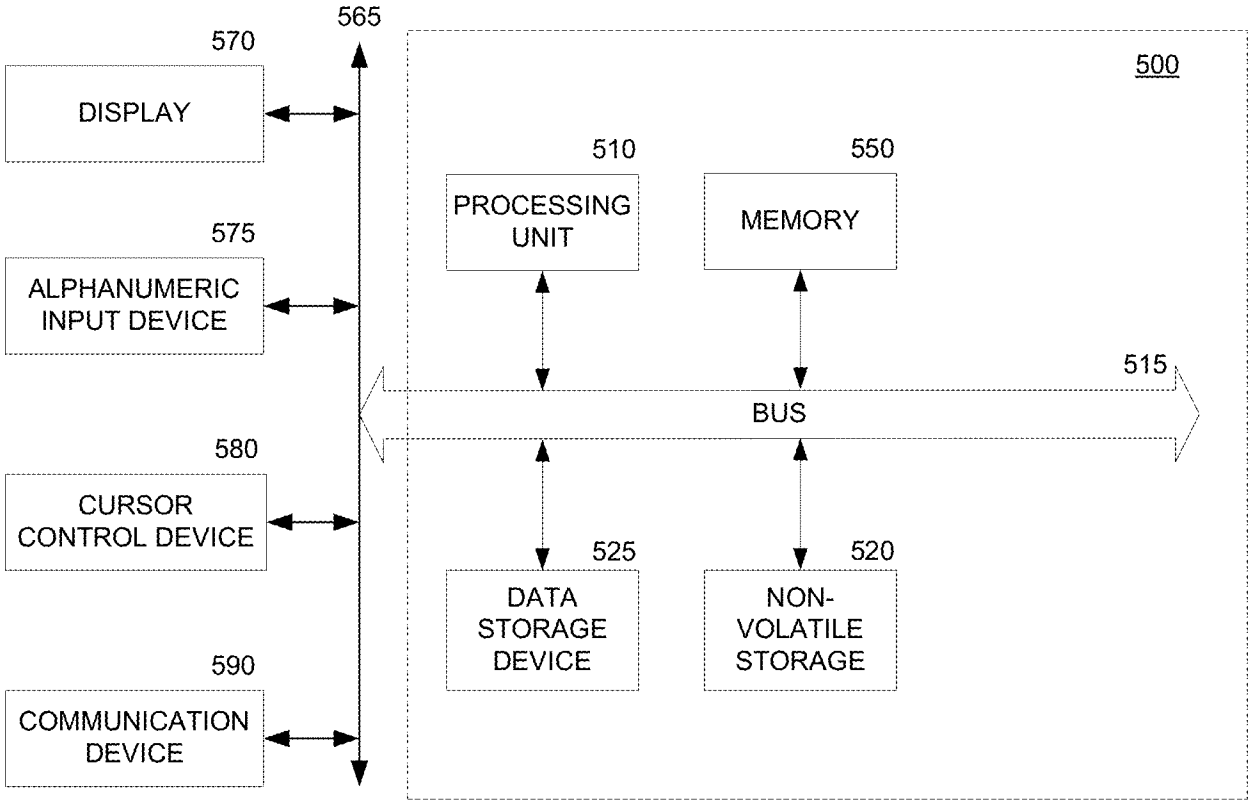
FIG. 5 is a functional block diagram illustrating elements of a hardware platform according to an embodiment.

FIG. 5 is an illustration of components of a device to utilize an embodiment of the disclosure. Platform 500 may be used for controlling the formation of reinforcement structures by a drill device as described herein. For example, platform 500 may be such a drill device, or a component thereof. Alternatively, platform 500 may be operable to communicate with such a drill device—e.g., where resources 100 include platform 500. Platform 500 as illustrated includes bus or other internal communication means 515 for communicating information, and processor 510 coupled to bus 515 for processing information. The platform further comprises random access memory (RAM) or other volatile storage device 550 (alternatively referred to herein as main memory), coupled to bus 515 for storing information and instructions to be executed by processor 510. Main memory 550 also may be used for storing temporary variables or other intermediate information during execution of instructions by processor 510. Platform 500 also comprises read only memory (ROM) and/or static storage device 520 coupled to bus 515 for storing static information and instructions for processor 510, and data storage device 525 such as a magnetic disk, optical disk and its corresponding disk drive, or a portable storage device (e.g., a universal serial bus (USB) flash drive, a Secure Digital (SD) card). Data storage device 525 is coupled to bus 515 for storing information and instructions.

Platform 500 may further be coupled to display device 570, such as a cathode ray tube (CRT) or an LCD coupled to bus 515 through bus 565 for displaying information to a computer user. Alphanumeric input device 575, including alphanumeric and other keys, may also be coupled to bus 515 through bus 565 (e.g., via infrared (IR) or radio frequency (RF) signals) for communicating information and command selections to processor 510. An additional user input device is cursor control device 580, such as a mouse, a trackball, stylus, or cursor direction keys coupled to bus 515 through bus 565 for communicating direction information and command selections to processor 510, and for controlling cursor movement on display device 570. In embodiments utilizing a touch-screen interface, it is understood that display 570, input device 575 and cursor control device 580 may all be integrated into a touch-screen unit.

Another device, which may optionally be coupled to platform 500, is a communication device 590 for accessing other nodes of a distributed system via a network. Communication device 590 may include any of a number of commercially available networking peripheral devices such as those used for coupling to an Ethernet, token ring, Internet, or wide area network. Communication device 590 may further be a null-modem connection, or any other mechanism that provides connectivity between computer system 500 and the outside world. Note that any or all of the components of this system illustrated in FIG. 5 and associated hardware may be used in various embodiments of the disclosure.

It will be appreciated by those of ordinary skill in the art that any configuration of the system illustrated in FIG. 5 may be used for various purposes according to the particular implementation. The control logic or software implementing embodiments of the disclosure can be stored in main memory 550, mass storage device 525, or other storage medium locally or remotely accessible to processor 510.

It will be apparent to those of ordinary skill in the art that any system, method, and process to capture media data as described herein can be implemented as software stored in main memory 550 or read only memory 520 and executed by processor 510. This control logic or software may also be resident on an article of manufacture comprising a computer readable storage medium having computer readable program code embodied therein and being readable the mass storage device 525 and for causing processor 510 to operate in accordance with the methods and teachings herein.

Embodiments of the disclosure may also be embodied in a handheld or portable device containing a subset of the computer hardware components described above. For example, the handheld device may be configured to contain only the bus 515, the processor 510, and memory 550 and/or 525. The handheld device may also be configured to include a set of buttons or input signaling components with which a user may select from a set of available options. The handheld device may also be configured to include an output apparatus such as a LCD or display element matrix for displaying information to a user of the handheld device. Conventional methods may be used to implement such a handheld device. The implementation of the disclosure for such a device would be apparent to one of ordinary skill in the art given the disclosure as provided herein.

Embodiments of the disclosure may also be embodied in a special purpose appliance including a subset of the computer hardware components described above. For example, the appliance may include processor 510, data storage device 525, bus 515, and memory 550, and only rudimentary communications mechanisms, such as a small touch-screen that permits the user to communicate in a basic manner with the device. In general, the more special-purpose the device is, the fewer of the elements need be present for the device to function.

Techniques and architectures for reinforcing a tunnel are described herein. In the above description, for purposes of explanation, numerous specific details are set forth in order to provide a thorough understanding of certain embodiments. It will be apparent, however, to one skilled in the art that certain embodiments can be practiced without these specific details. In other instances, structures and devices are shown in block diagram form in order to avoid obscuring the description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed description herein are presented in terms of algorithms and symbolic representations of operations on data bits within a computer memory. These algorithmic descriptions and representations are the means used by those skilled in the computing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Certain embodiments also relate to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs) such as dynamic RAM (DRAM), EPROMs, EEPROMs, magnetic or optical cards, or any type of media suitable for storing electronic instructions, and coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description herein. In addition, certain embodiments are not described with reference to any particular programming language. It will be appreciated that a variety of programming languages may be used to implement the teachings of such embodiments as described herein.

Besides what is described herein, various modifications may be made to the disclosed embodiments and implementations thereof without departing from their scope. Therefore, the illustrations and examples herein should be construed in an illustrative, and not a restrictive sense. The scope of the invention should be measured solely by reference to the claims that follow.

What is claimed is:

1. A device comprising:

a drill head to drill a tunnel;

a housing coupled to the drill head, the housing to receive dirt while the drill head drills the tunnel;

a dirt conditioning unit disposed in the housing and configured to collect the dirt and to condition a first portion of the dirt by mixing the first portion of the dirt with a binder to form a casing material, the binder comprising an epoxy; and a compactor including a pump and a die, the pump coupled to receive the casing material from the dirt conditioning unit and to force the casing material through the die as an extrusion and out a rear end of the housing to form a reinforcement structure disposed along a side of the tunnel, wherein the die forms a cross-sectional shape of the reinforcement structure as the casing material is extruded.

2. The device of claim 1, the dirt conditioning unit further to deposit dirt as waste material within the tunnel.

3. The device of claim 1, wherein the dirt conditioning unit further comprises:

a first mixer coupled to receive the dirt excavated by the drill head and mix the dirt with water to form a mixture; and a second mixer coupled to receive a first portion of the mixture from the first mixer and further mix the first portion of the mixture with the binder to form the casing material.

4. The device of claim 3, wherein the dirt conditioning unit further comprises:

a third mixer coupled to the first mixer to receive a second portion of the mixture and to dilute the second portion of the mixture to form a waste fluid, the dirt conditioning unit further to send the waste fluid from the device to an above-ground location via the tunnel.

5. The device of claim 1, further comprising a spool to pay out a cable from the device into the tunnel while the tunnel is being drilled.

6. The device of claim 1, further comprising a cure unit disposed within or adjacent to the compactor to expose the casing material to ultraviolet light prior to or during extrusion of the casing material through the die to induce at least partial curing of the epoxy.

7. The device of claim 1, wherein the dirt conditioning unit to condition the first portion of the dirt includes the dirt conditioning unit to disintegrate and sift the dirt.

8. The device of claim 1, wherein the dirt conditioning unit to condition the first portion of the dirt includes the dirt conditioning unit to convey the first portion with a peristaltic pump.

9. The device of claim 1, wherein the die comprises an annular shaped die.

10. A method comprising:

collecting dirt received in a capsule during drilling at a first end of the capsule, the drilling to form a tunnel;

conditioning in the capsule a first portion of the dirt, including mixing the first portion with a binder to form a casing material, the binder comprising an epoxy; and extruding the casing material from a second end of the capsule to form a reinforcement structure disposed along a side of the tunnel, wherein extruding the casing material includes forcing the casing material through a die having a cross-sectional shape of the reinforcement structure with a pump.

11. The method of claim 10, further comprising depositing dirt as waste material within the tunnel.

12. The method of claim 10, wherein conditioning the first portion of the dirt comprises:

mixing the dirt with water to form a mixture, wherein a portion of the mixture includes the first portion of the dirt; and mixing a portion of the mixture with the binder to form the casing material.

13. The method of claim 12, further comprising:

diluting another portion of the mixture to form a waste fluid; and sending the waste fluid from the capsule to an above-ground location via the tunnel.

14. The method of claim 10, further comprising paying out a cable from the capsule into the tunnel during the drilling.

15. The method of claim 10, further comprising exposing the casing material to ultraviolet light to induce at least partial curing of the epoxy.

16. The method of claim 10, wherein conditioning the first portion of the dirt includes disintegrating and sifting the dirt.

17. The method of claim 10, wherein conditioning the first portion of the dirt and extruding the casing material includes conveying the first portion of the dirt with a peristaltic pump.

18. A system comprising:

a capsule including:

a drill head to drill a tunnel;

a housing coupled to the drill head, the housing to receive dirt while the drill head drills the tunnel;

a dirt conditioning unit disposed in the housing and configured to collect the dirt and to condition a first portion of the dirt by mixing the first portion of the dirt with a binder to form a casing material, the binder comprising an epoxy; and a compactor including a pump and a die, the pump coupled to receive the casing material from the dirt conditioning unit and to force the casing material through the die as an extrusion and out a rear end of the housing to form a reinforcement structure disposed along a side of the tunnel wherein the die forms a cross-sectional shape of the reinforcement structure as the casing material is extruded; and a cable coupled to the capsule and extending from the housing, the cable to couple the capsule to a computer platform and to exchange control signals between the capsule and the computer platform while the drill head drills the tunnel.

19. The system of claim 18, the dirt conditioning unit further to deposit dirt as waste material within the tunnel.

20. The system of claim 18, wherein the dirt conditioning unit comprises a first mixer and a second mixer, and wherein the dirt conditioning unit to condition the first portion of the dirt comprises:

the first mixer to mix the dirt with water to form a mixture, wherein a portion of the mixture includes the first portion of the dirt; and the second mixer to receive the portion of the mixture from the first mixer and to mix the portion of the mixture with the binder to form the casement material.

21. The system of claim 20, wherein the dirt conditioning unit further comprises a third mixer to receive another portion of the mixture from the first mixer and to dilute the other portion of the mixture to form a waste fluid, the dirt conditioning unit further to send the waste fluid from the capsule to an above-ground location via the tunnel.

22. The system of claim 18, the capsule further comprising a spool to pay out a cable from the capsule into the tunnel while the tunnel is being drilled.

* * * * *